US011551886B2

(12) United States Patent
Huang et al.

(10) Patent No.: US 11,551,886 B2
(45) Date of Patent: Jan. 10, 2023

(54) ENHANCED PUSH-BUTTON

(71) Applicant: SOLID YEAR CO., LTD., New Taipei (TW)

(72) Inventors: Chi-Tsung Huang, New Taipei (TW); Chao-Hsin Lin, New Taipei (TW); Shen-Jun Tang, Dongguan (CN)

(73) Assignee: SOLID YEAR CO., LTD., New Taipei (TW)

( * ) Notice: Subject to any disclaimer, the term of this patent is extended or adjusted under 35 U.S.C. 154(b) by 0 days.

(21) Appl. No.: 16/594,578

(22) Filed: Oct. 7, 2019

(65) Prior Publication Data

US 2020/0185164 A1 Jun. 11, 2020

(30) Foreign Application Priority Data

Dec. 7, 2018 (CN) ..... 201811500219.2
Sep. 25, 2019 (CN) ..... 201910914537.1

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2209/01* (2013.01); *H01H 2233/07* (2013.01)

(58) Field of Classification Search
CPC ..... H01H 2209/01; H01H 2233/07; H01H 2221/056; H01H 2221/08; H01H 3/12; H01H 3/122; H01H 3/125
See application file for complete search history.

(56) References Cited

U.S. PATENT DOCUMENTS

| | | | | |
|---|---|---|---|---|
| 6,689,977 | B2 * | 2/2004 | Ito | H01H 3/125 200/344 |
| 8,624,140 | B2 * | 1/2014 | Nishino | H01H 3/122 200/302.2 |
| 9,373,454 | B2 * | 6/2016 | Takemae | H01H 3/125 |
| 9,455,097 | B2 * | 9/2016 | Chen | H01H 3/125 |
| 10,340,100 | B1 * | 7/2019 | Yang | H01H 13/85 |
| 2008/0093206 | A1 * | 4/2008 | Chang | H01H 13/14 200/341 |

FOREIGN PATENT DOCUMENTS

| | | | |
|---|---|---|---|
| CN | 201029081 | Y | 2/2008 |
| CN | 103383902 | A | 11/2013 |
| CN | 105655180 | A | 6/2016 |
| CN | 104124091 | B | 12/2017 |

* cited by examiner

*Primary Examiner* — Felix O Figueroa
(74) *Attorney, Agent, or Firm* — Birch Stewart, Kolasch & Birch, LLP

(57) ABSTRACT

An enhanced push-button includes a keycap disposed on an elastic member and having a top surface and an opposing bottom surface, and a reinforcing member mounted on the bottom surface of the keycap and having an outer surface facing the elastic member and an abutting portion located on the outer surface. The abutting portion has a contact surface recessed on the outer surface. The elastic member extends into the abutting portion such that the contact surface is abutted against the elastic member for allowing the keycap to be pressed with the reinforcing member against the elastic member to trigger a circuit switch. The invention can have better overall structural rigidity and operating feel and can maintain the pressing quality of the push-button and is suitable for low profile keyboards.

17 Claims, 11 Drawing Sheets

ENHANCED PUSH-BUTTON

BACKGROUND OF THE INVENTION

1. Field of the Invention

The present invention relates to key switch technology and more particularly, to an enhanced push-button with a thin overall structure and strong rigidity.

2. Description of the Related Art

As the overall design of notebook computers becomes thinner and lighter, in addition to continuously mounting more functional electronic circuit components in a very small internal space, computer manufacturers must let various electronic circuit components have the same functions or even play better functions than ever before, in order to meet the needs of consumers and the market.

Taking the keyboard for a notebook computer as an example, the current common keyboards can be divided into mechanical keyboards and membrane keyboards. If you want an intuitive and stable press-button feedback and a long-lasting typing experience, the user's first choice is a mechanical keyboard. Although operating the push-buttons of a mechanical keyboard has a better pressing feel, the overall cost is higher, so the membrane keyboard provides another operation that is different from the mechanical keyboard.

In order to make the aforementioned various keyboards meet the requirements of the thin and light design of notebook computers, in addition to lowering the height of each component of the keyboard, the keyboard can also reduce the actuation stroke of each push-button.

Or it is designed to change the pressing relationship between the push-button and the silicone elastic member to have a preloading state, so as to meet the requirement of lowering the overall keyboard height.

At present, the common scissors-type push-button actuation stroke can be reduced to 0.8 mm and continues to be actively design toward less actuation strokes. How to meet the design conditions of reducing the height of the structure and the actuation stroke, and also taking into account the structural rigidity of the overall button, especially for the special buttons that strengthen the ratio of length to width, is an important topic in keyboard design.

For example, China Patent CN104124091B discloses a push-button switch and a keyboard. As shown in FIG. 9 of the specification, the back surface 112 of the keycap 104 is provided with a reinforcing plate 200 to enhance the structural rigidity. The reinforcing plate 200 has a center hole 208. The center hole 208 is formed at a position corresponding to the biasing portion 134 of the switch mechanism 110 (that is, the above-mentioned silicone elastic member), and the biasing portion 134 can pass through the center hole 208 of the reinforcing plate 200 and can then be pre-pressed on the back surface 112 of the keycap 104. Another example is the push-button structure disclosed in the Chinese Utility Model CN105655180A. Similarly, a reinforcing plate 7 is set on the bottom surface of the keycap 3. The reinforcing plate 7 has a through hole 71. The silicone elastic member is directly contacted through the through hole 71 and preloaded on the bottom surface of the keycap 3. However, after the above-mentioned respective push-buttons have undergone environmental testing, it is often impossible for the push-buttons to be moved normally when they are pressed on both sides, so that the pressed push-button cannot compress the biasing portion 134 or the silicone elastic member to turn on the circuit switch, leading to a non-conduction problem.

Another example is the key cap structure disclosed in the Chinese Utility Model CN201029081Y, which is to place the reinforcing component on the bottom surface of the keycap to achieve the purpose of strengthening the keycap. However, if the thickness of the above reinforcing component is too thin, the reinforcing effect cannot be achieved. If the thickness of the reinforcing component is too thick, the pressure pre-stressed on the silicone elastic member will be too large. Thus, the elastic member can easily exceed the stroke position of the paragraph drop point, which causes the operation to have a poor sense of touch or a problem without a paragraph, and seriously affects the service life of the silicone elastic member. In summary, the existing push-buttons still have many design problems and challenges that need to be broken.

SUMMARY OF THE INVENTION

The present invention has been accomplished under the circumstances in view. It is the main object of the present invention to provide an enhanced push-button, which has better overall structural rigidity and operating feel, can maintain the pressing quality of the push-button and is suitable for use in a low profile keyboard.

To achieve this and other objects of the present invention, an enhanced push-button comprises a keycap and a reinforcing member. The keycap is disposed above an elastic member, comprising a top surface and an opposing bottom surface. The reinforcing member is mounted on the bottom surface of the keycap, comprising an outer surface and an abutting portion located on the outer surface. The abutting portion comprises a contact surface recessed on the outer surface. The outer surface faces the elastic member. The elastic member extends into the abutting portion such that the contact surface is abutted against the elastic member for allowing the keycap to be pressed with the reinforcing member against the elastic member to trigger a circuit switch. By means of utilizing the above-mentioned constituent members, the present invention has better overall structural rigidity and operating feel and can maintain the pressing quality of the push-button and is suitable for use in a low profile keyboard.

Other advantages and features of the present invention will be fully understood by reference to the following specification in conjunction with the accompanying drawings, in which like reference signs denote like components of structure.

DETAILED DESCRIPTION OF THE INVENTION

It should be noted that the enhanced button provided by the present invention can be widely applied to various types of keyboards, such as membrane keyboards or mechanical keyboards. Those skilled in the art should be able to understand that the constituent members, explanatory terms, and the like in the present preferred embodiment are all generic descriptions that do not limit specific components or technical fields, and the quantity term "a" includes the number of one or more plural elements.

Figure 1:
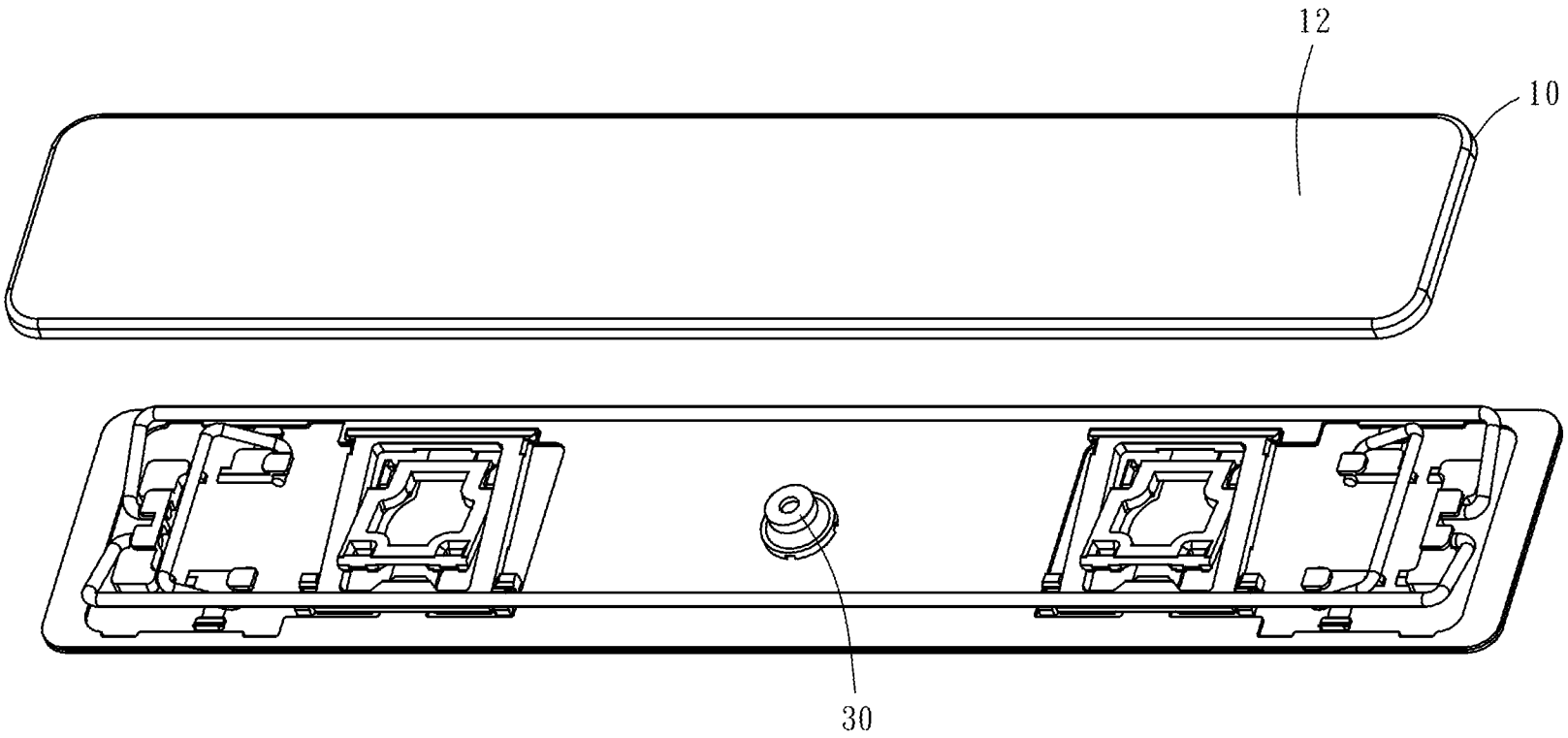
FIG. 1 is an exploded view of an enhanced push-button in accordance with a first embodiment of the present invention.
Figure 2:
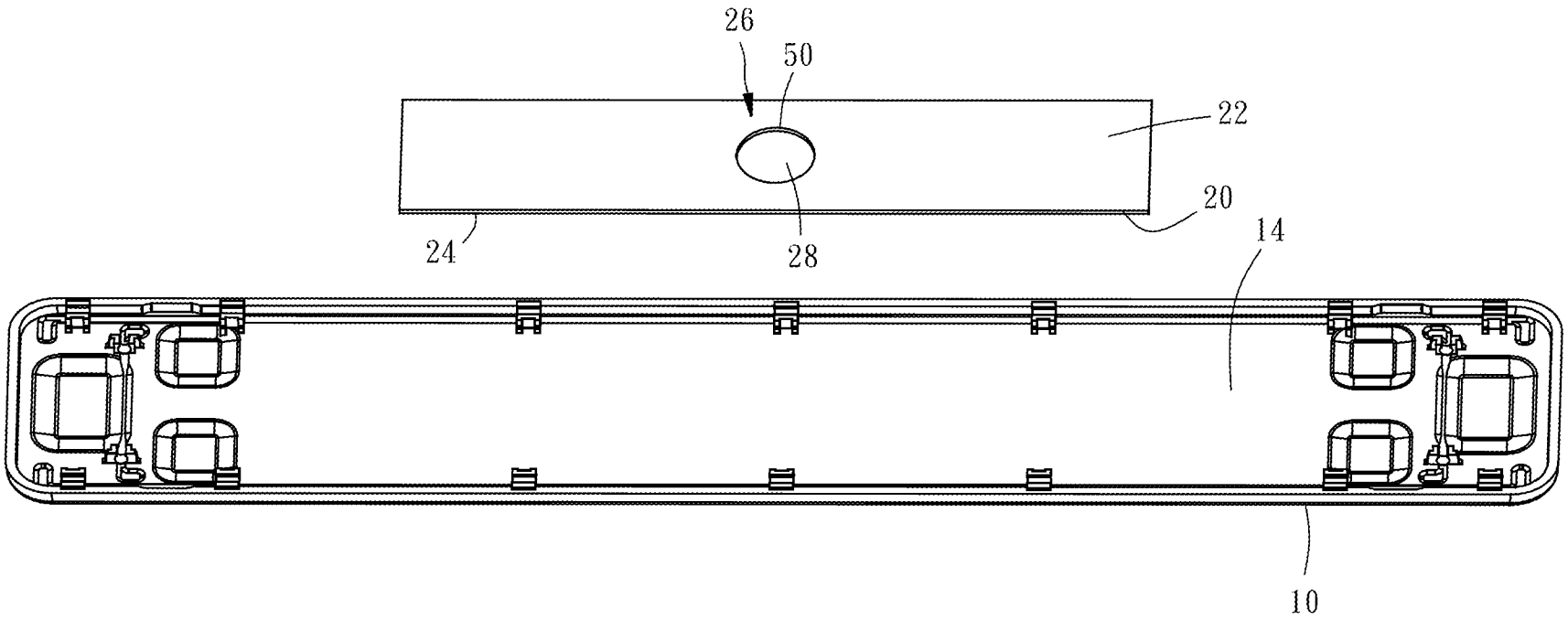
FIG. 2 is an exploded view of the first embodiment of the present invention, showing the state of another angle.
Figure 3:
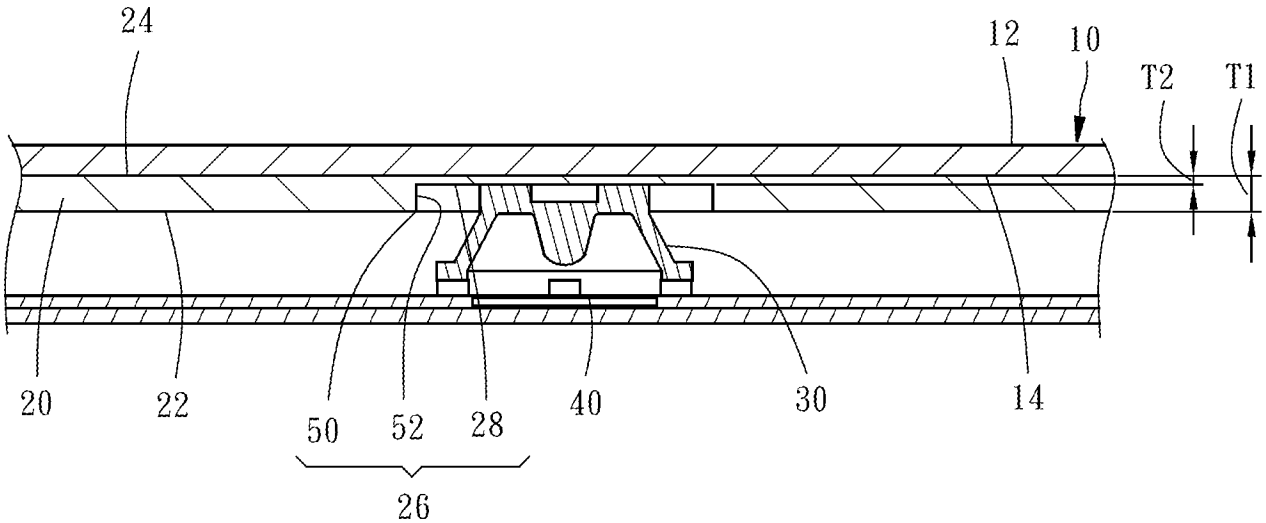
FIG. 3 is a sectional view of a part of the enhanced push-button in accordance with the first embodiment of the present invention.

Referring to FIG. 1, FIG. 2 and FIG. 3, an enhanced push-button in accordance with the present invention mainly comprises a keycap 10 and a reinforcing member 20. The keycap 10 is disposed above an elastic member 30. The elastic member 30 of the preferred embodiment is exemplified by a silicone elastic member. The enhanced push-button of the present invention is disposed above a keyboard bottom plate 18. The bottom plate 18 is further provided with a circuit switch 40, the elastic member 30, and a scissor linkage 17 connecting the enhanced push-button and the bottom plate 18, so that the keycap 10 can be pressed with the reinforcing member 20 against the elastic member 30 to trigger the circuit switch 40.

The keycap 10 has a top surface 12 and an opposing bottom surface 14. The reinforcing member 20 is mounted on the bottom surface 14 of the keycap 10 of the enhanced push-button. In the present preferred embodiment, the reinforcing member 20 is exemplified by an elongated plate whose material rigidity is greater than keycap 10, such as various metal plates. The reinforcing member 20 has an abutting portion 26 corresponding to the elastic member 30. The abutting portion 26 has an outer surface 22, an opposing inner surface 24, and a first thickness T1 between the outer surface 22 and the inner surface 24. The abutting portion 26 comprise an edge 50, an inner wall 52 disposed along the edge 50, and a contact surface 28 located inside the edge 50 and the inner wall 52. The edge 50 of the present preferred embodiment is formed by a closed curve as example, such as a circle or other closed curve with similar characteristics. The edge 50 is directly formed on the outer surface 22, and the inner wall 52 is extend from the edge 50 to the inner surface 24 and surrounds the contact surface 28, thereby forming the contact surface 28 recessed on the outer surface 22, wherein a second thickness T2 between the inner surface 24 and the contact surface 28. The first thickness T1 is greater than the second thickness T2. The inner wall 52 between the outer surface 22 and the contact surface 28 may be vertical or inclined. The outer surface 22 faces the elastic member 30, and the elastic member 30 extends into the abutting portion 26 of the outer surface 22 of the reinforcing member 20 to directly abut against the contact surface 28. Since the elastic member 30 extends into the outer surface 22 of the abutting portion 26 of the reinforcing member 20 to directly abut against the contact surface 28, the reinforcing member 20 can increase the overall strength of the key cap 10 by using its own material characteristics, and the elastic member 30 does not touch the keycap 10. Therefore, the elastic force of the elastic member 30 will not cause deformation of the keycap 10 during environmental testing.

Figure 5:
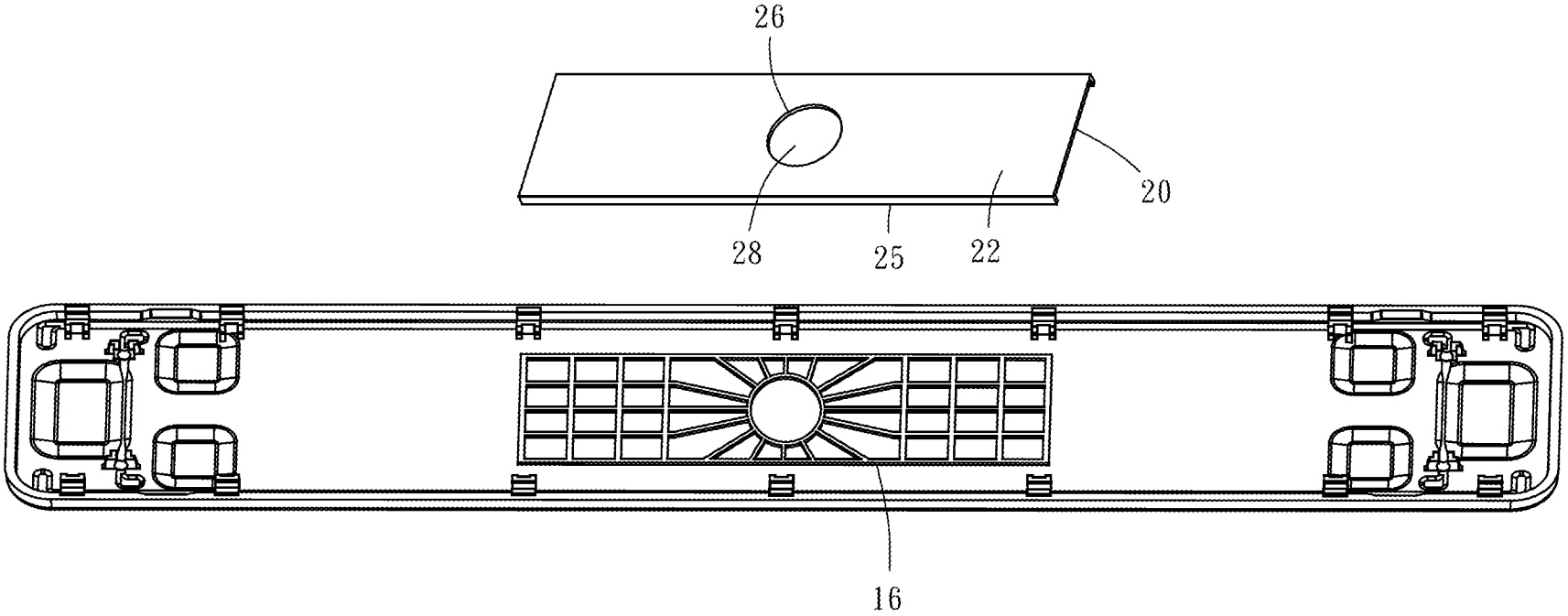
FIG. 5 is similar to FIG. 2, mainly showing still another implementation of the reinforcing member.

The reinforcing member 20 of the preferred embodiment is exemplified by a monolithic plate body, and the opposite surface of the outer surface 22 is also exemplified by a plane. The opposite face of the contact surface 28 may alternatively be substantially the same height as the opposite face of the outer surface 22, or the opposite face of the contact surface 28 as shown in FIG. 5 may alternatively protrude from the opposite face of the outer surface 22.

Figure 6:
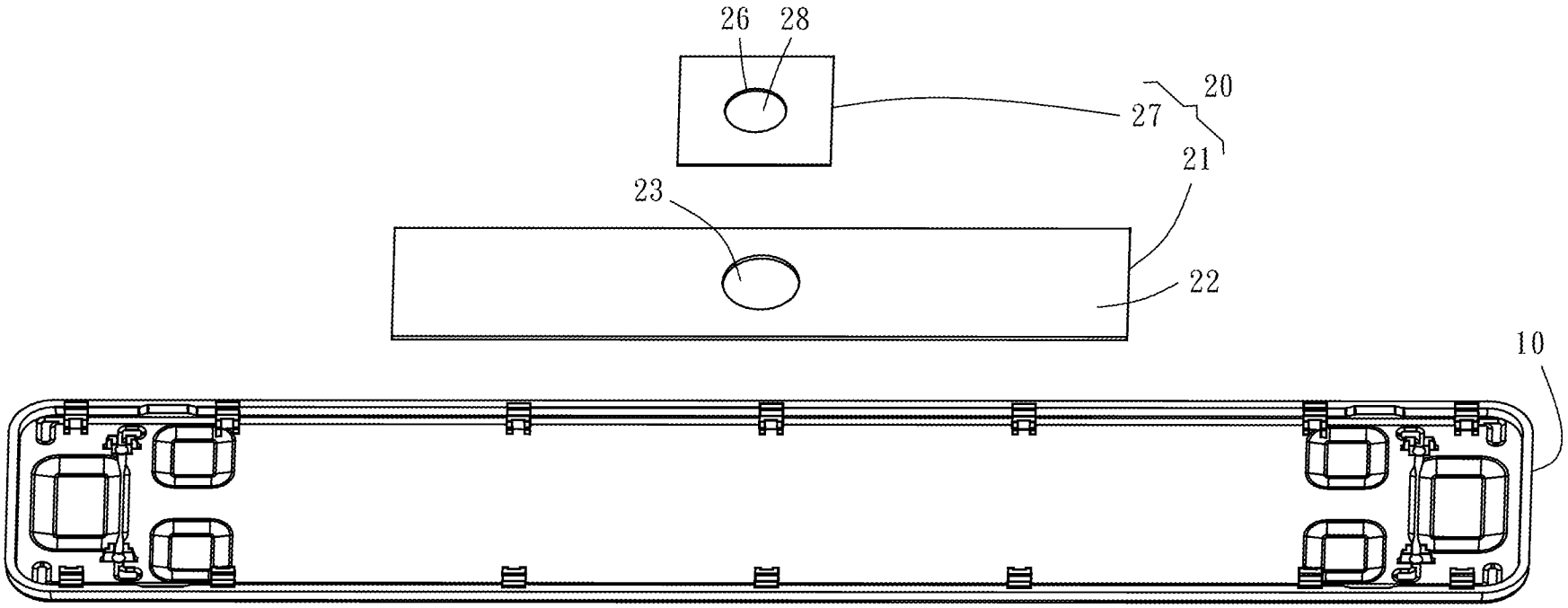
FIG. 6 is an exploded view of an enhanced push-button in accordance with a second embodiment of the present invention.
Figure 7:
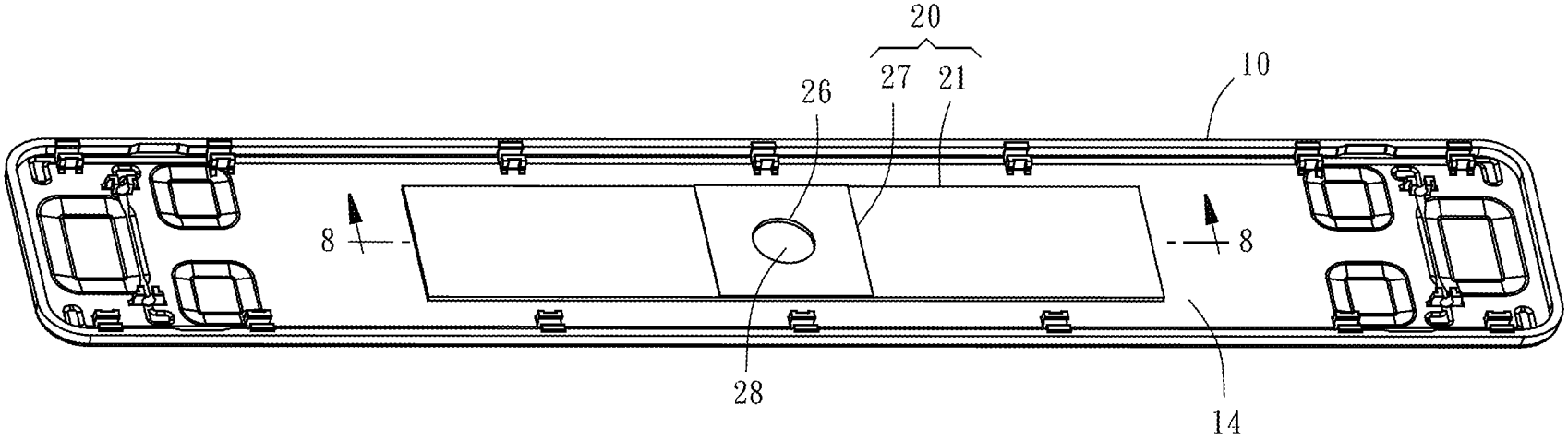
FIG. 7 is an assembly view of the enhanced push-button in accordance with the second embodiment of the present invention.
Figure 8:
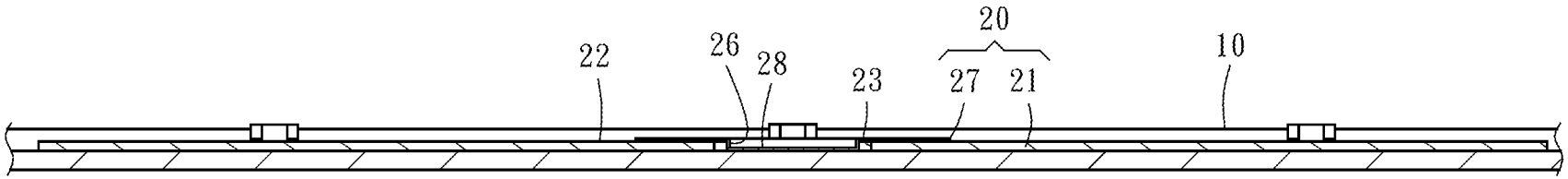
FIG. 8 is a sectional view taken along line 8-8 of FIG. 7.
Figure 11:
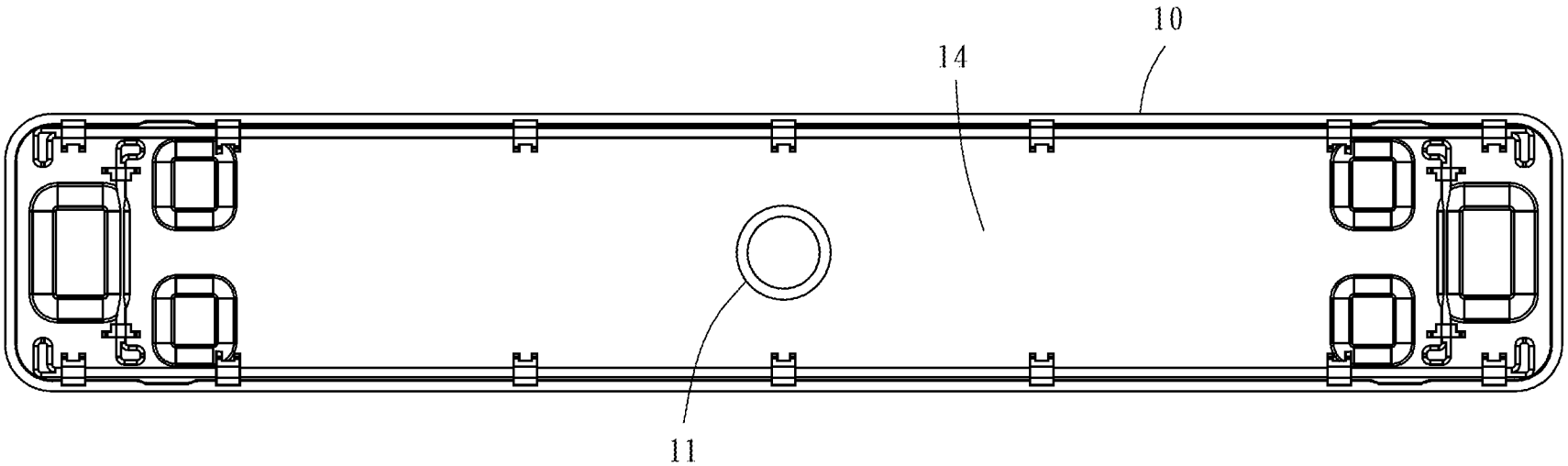
FIG. 11 is a top view of an enhanced push-button in accordance with a fourth embodiment of the present invention, mainly showing the configuration of the bottom surface of the keycap.
Figure 12:
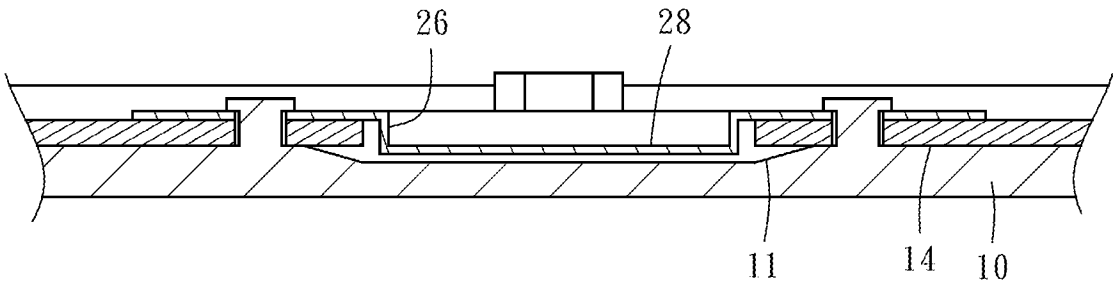
FIG. 12 is a partial sectional view of the fourth embodiment of the present invention.

It is worth mentioning that, in addition to the monolithic plate as described above, the reinforcing member 20 can also be as shown in FIG. 6, FIG. 7, and FIG. 8. As illustrated, the reinforcing member 20 comprises a first coupling member 21 and a second coupling member 27. The first coupling member 21 has a through hole 23. The second coupling member 27 has an abutting portion 26. The second coupling member 27 is disposed on the first coupling member 21 with the abutting portion 26 located at the position corresponding to the through hole 23. Similarly, the contact surface 28 in the abutting portion 26 can be used to press the elastic member, thereby achieving the technical features of the present invention. Alternatively, the thickness between the contact surface 28 of the abutting portion 26 of the second coupling member 27 and the inner surface 24 may be less than the thickness between the outer surface 22 of the first coupling member 21 and the inner surface 24. The material of the first coupling member 21 and the second coupling member 27 may be metal or a combination of plastic and metal according to the state of use, as long as the overall height is thin. Further, as shown in FIGS. 11 and 12, the bottom surface 14 of the keycap 10 may be provided with a recess 11 corresponding to the abutting portion 26 of the reinforcing member 20. The height of the contact surface 28 can also be selectively equal to, higher than, or lower than the height of the bottom surface 14 of the keycap 10.

Figure 4:
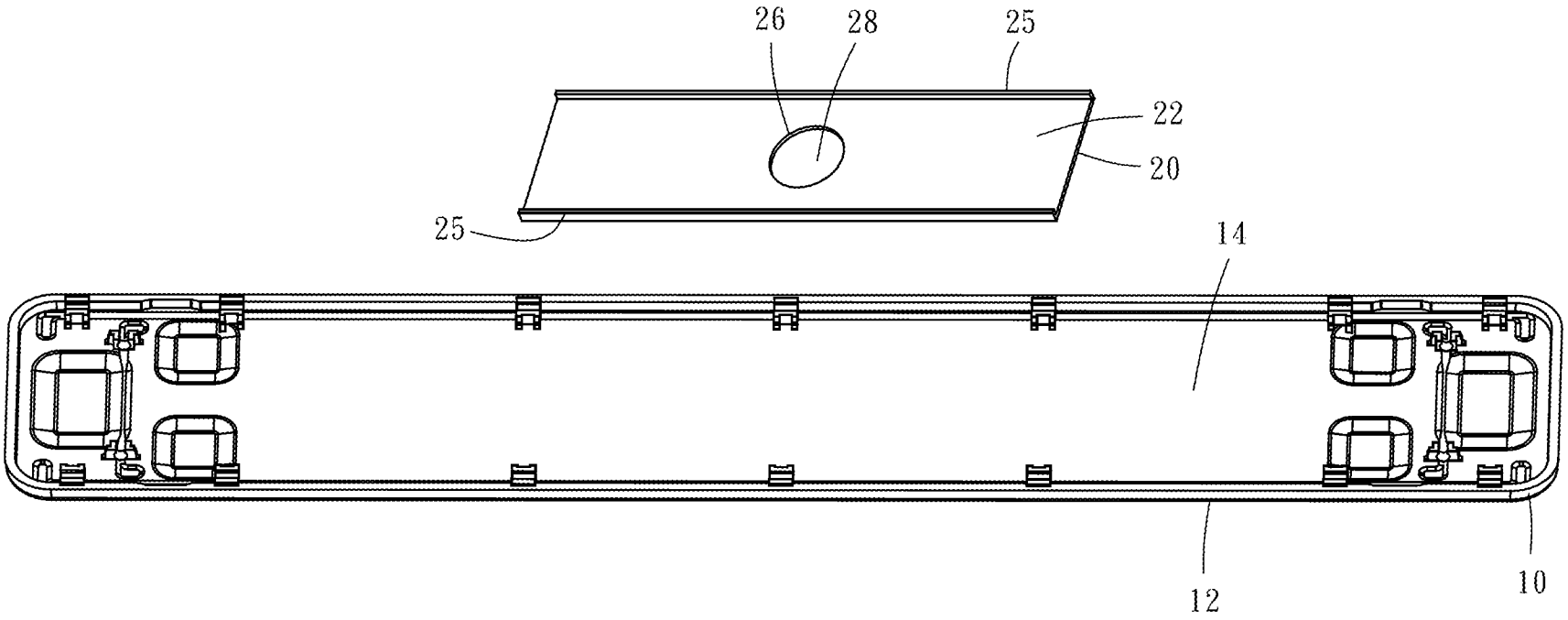
FIG. 4 is similar to FIG. 2, mainly showing another implementation of the reinforcing member.

In order to increase the structural strength of the reinforcing member 20 without increasing the thickness of the reinforcing member 20, as shown in FIG. 4, two opposite sides of the reinforcing member 20 can be respectively provided with an extension portion 25. The extension portion 25 in the present preferred embodiment is disposed on each of the two opposite long sides of the reinforcing member 20. The extension portion 25 can also be placed on each of the two opposite short sides or the four sides of the reinforcing member 20. If each extension portion 25 extends from the reinforcing member 20 toward the elastic member 30, the inner surface 24 of the reinforcing member 20 may be set to the bottom surface 14 of the keycap 10. Alternatively, as shown in FIG. 5, the extension portion 25 extends from the reinforcing member 20 toward the keycap 10, and the inner surface 24 of the reinforcing member 20 can be placed on the rib 16 at the bottom surface 14 of the keycap 10. The opposite surface of the contact surface 28 may be flush with the inner surface 24 or protrude from the inner surface 24. The reinforcing member 20 can be selectively made of metal or made of a plastic material having a stronger strength depending on the structural strength.

Figure 9:
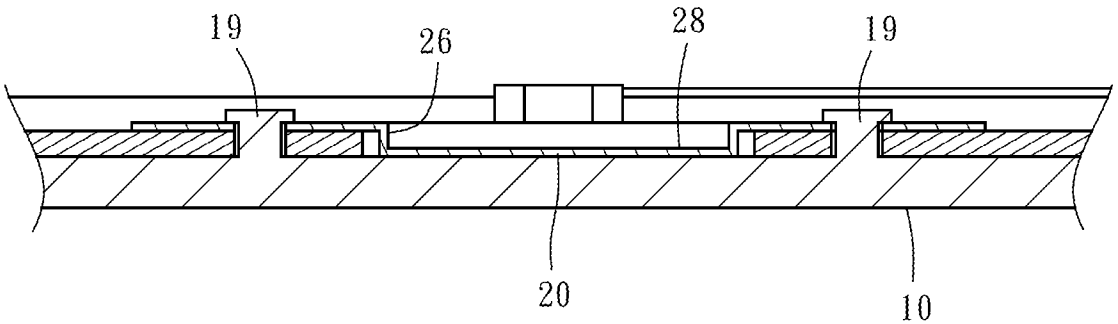
FIG. 9 is a partial sectional view of an enhanced push-button in accordance with a third embodiment of the present invention.
Figure 10:
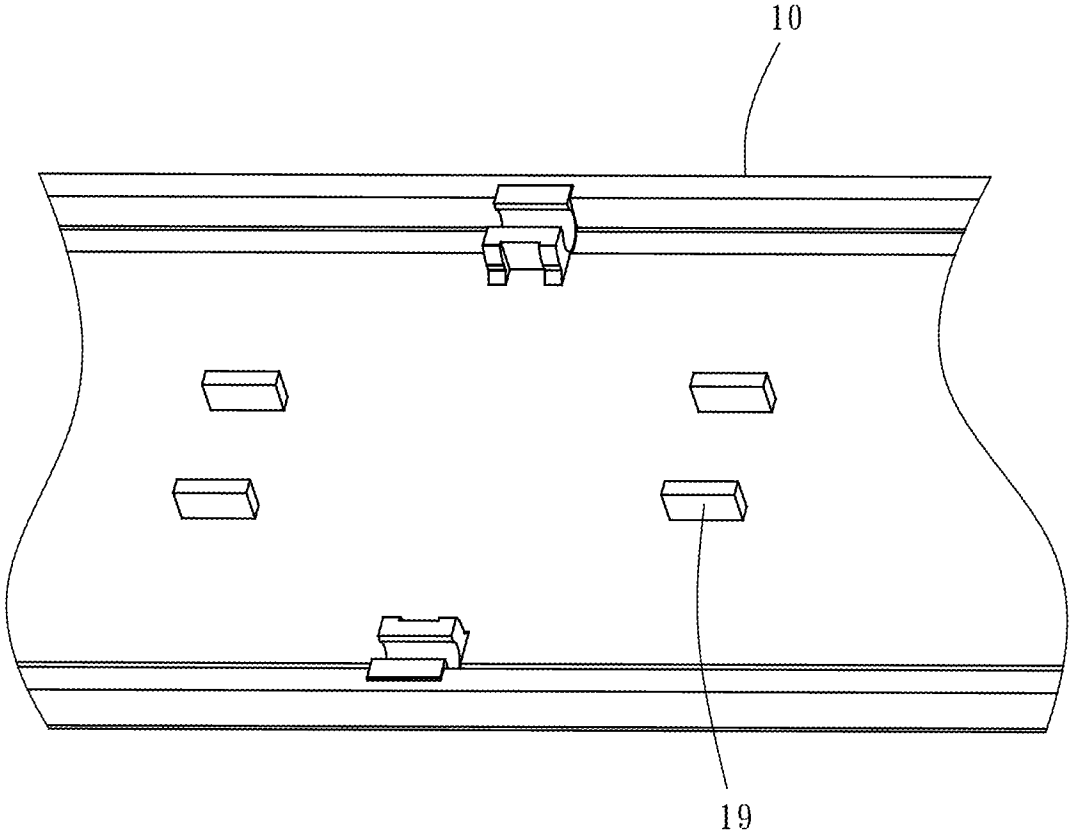
FIG. 10 is an elevational view of a part of the third embodiment of the present invention, mainly showing the configuration of the fixing portion.

As shown in FIG. 9, the bottom surface 14 of the keycap 10 is directly provided with a fixing portion 19. The fixing portion 19 in the present preferred embodiment is exemplified by a heat-melting column. Alternatively, the reinforcing member 20 and the keycap 10 can also be combined by means of gluing, hooking, or the like. As shown in FIG. 10, the fixing portion 19 at the bottom surface 14 of the keycap 10 may be rectangular, circular, or oblong, and the front end of the fixing portion 19 may also be provided with a lead angle to facilitate setting the reinforcing member 20.

As shown in FIG. 11, the bottom surface 14 of the key cap 10 is provided with a recess 11 at the position corresponding to the abutting portion 26. The inner wall surface of the recess 11 may be vertical or inclined as shown in FIG. 12. The height of the contact surface 28 of the abutting portion 26 of the second coupling member 27 may be blush with, or higher or lower than the height of the bottom surface 14 of the key cap 10.

Figure 13:
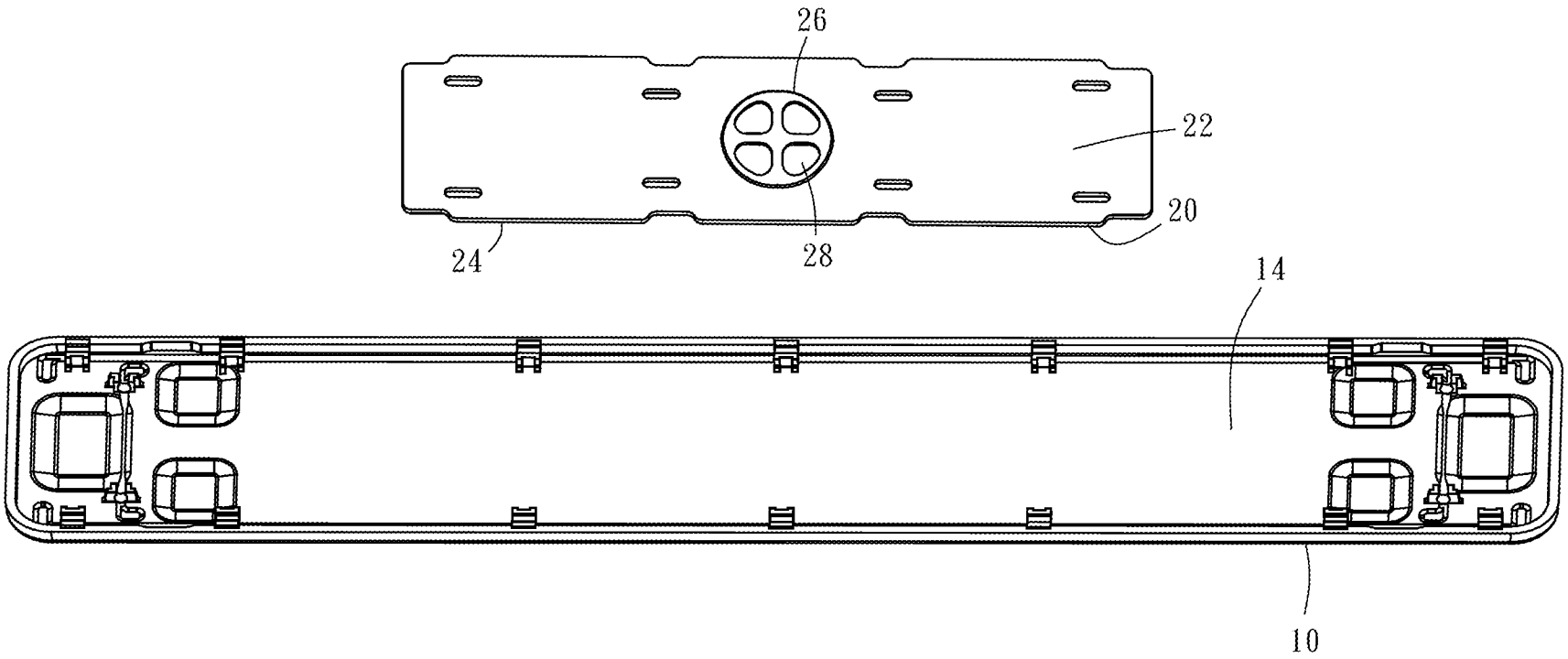
FIG. 13 is an exploded view of an enhanced push-button in accordance with a fifth embodiment of the present invention.

As shown in FIG. 13, in order to match various processing processes, for example, in order to improve the processing quality and easy manufacturability of the reinforcing member 20 in press working, the abutting portion 26 of the reinforcing member 20 may be in the shape of a cross or other sheet-like form having an opening, so that the abutting portion 26 also has a contact surface 28 which can resist the elastic member, and can also have the technical features and effects of the present invention.

With the above-described constituent members of the present invention, the keycap 10 is coupled with the reinforcing member 20 to increase the overall rigidity of the push-button, and the abutting portion 26 recessed in the reinforcing member 20 further presses the contact surface 28 against the elastic member 30. Thus, the structural rigidity is maintained without increasing the overall height of the push-button. More importantly, the contact surface 28 of the abutting portion 26 is pre-stressed against the elastic member 30 at a low pressure. The reinforcing member 20 of the present invention does not cause the pre-stress of the push-button to be excessively large, avoiding causing the elastic member 30 to lose its own characteristics. Thus, the elastic member 30 of the present invention can maintain a good characteristic curve, so that the present invention can be applied to a low-profile keyboard and can also meet various mechanical and performance quality specifications to achieve the object of the invention.

What is claimed is:

1. An enhanced push-button, comprising:

a keycap disposed above an elastic member, said keycap comprising:

a top surface; and an opposing bottom surface; and a reinforcing member mounted on said bottom surface of said keycap, said reinforcing member having a top surface, a bottom surface, and an abutting portion corresponding to said elastic member, wherein the top surface of the reinforcing member engages with the bottom surface of the keycap, and an entire surface of the top surface of the reinforcing member is flat and lies on a same plane, wherein said abutting portion is recessed from the bottom surface of the reinforcing member to form a receiving space, the receiving space being defined by a surrounding sidewall extending from the bottom surface of the reinforcing member toward said top surface, and a contact surface fully surrounded by the surrounding sidewall, wherein said elastic member extends into the receiving space of said abutting portion and said contact surface is abutted against said elastic member for allowing said keycap to be pressed with said reinforcing member against said elastic member to trigger a circuit switch, wherein the receiving space has an area corresponding to the elastic member, said surrounding sidewall is distanced from all of outermost edges of the reinforcing member, and the reinforcing member has a consistent and same thickness between the top surface and bottom surface thereof except for the abutting portion, wherein the reinforcing member is a monolithic member, and wherein the reinforcing member includes two opposite long sides and two opposite short sides, and a shortest distance between the surrounding sidewall of the receiving space and one of the two opposite short sides is larger than a shortest distance between the surrounding sidewall of the receiving space and one of the two opposite long sides.

2. The enhanced push-button as claimed in claim 1, wherein the material rigidity of said reinforcing member is greater than said keycap.

3. The enhanced push-button as claimed in claim 1, wherein said reinforcing member further comprises at least one extension portion, said extension portion being selectively extended from said reinforcing member toward said elastic member or said keycap.

4. The enhanced push-button as claimed in claim 1, wherein said reinforcing member is directly stacked on said bottom surface of said keycap.

5. The enhanced push-button as claimed in claim 1, wherein said bottom surface of said keycap is provided with a fixing portion, said fixing portion selectively combining said reinforcing member and said keycap by means of heat-melting, gluing or hooking.

6. The enhanced push-button as claimed in claim 1, wherein said bottom surface of said keycap is provided with a recess at a position corresponding to said abutting portion, said recess having an inner wall surface selectively made in a vertical or inclined manner.

7. The enhanced push-button as claimed in claim 1, wherein the height of said contact surface of said abutting portion is selectively flush with, or higher or lower than said bottom surface.

8. The enhanced push-button as claimed m claim 1, wherein said reinforcing member is mounted on a rib of said keycap.

9. The enhanced push-button as claimed in claim 1, which is disposed above a bottom plate of a keyboard, said bottom plate being provided with a circuit switch, an elastic member and a scissor linkage connecting said enhanced push-button and said bottom plate, so that said keycap is allowed to be pressed with said reinforcing member against said elastic member to trigger said circuit switch.

10. The enhanced push-button as claimed in claim 1, wherein said abutting portion of said reinforcing member is provided with an opening, said contact surface of said abutting portion being abutted against said elastic member.

11. The enhanced push-button as claimed in claim 1, wherein said abutting portion comprises an edge, an inner wall disposed along said edge, and said contact surface located inside said edge and said inner wall.

12. The enhanced push-button as claimed in claim 11, wherein said edge is formed by a closed curve.

13. The enhanced push-button as claimed in claim 1, wherein the abutting portion is disposed at a center of the reinforcing member.

14. The enhanced push-button as claimed in claim 1, wherein the elastic member extends into the abutting portion to directly contact the contact surface such that the elastic member does not contact the keycap.

15. An enhanced push-button, comprising:

a keycap disposed above an elastic member, said keycap comprising:

a top surface; and an opposing bottom surface; and a reinforcing member mounted on said bottom surface of said keycap, wherein said reinforcing member comprises a first coupling member and a second coupling member, said first coupling member includes a top surface, a bottom surface and an opening, said second coupling member comprising a top surface, a bottom surface, and an abutting portion, said second coupling member being mounted on said first coupling member by extending the abutting portion of the second coupling member into the opening of the first coupling member, wherein said abutting portion protrudes from the top surface of the second coupling member to form a receiving space, the receiving space being defined by a surround sidewall extending from the top surface of the second coupling member toward the bottom surface of said keycap, and a contact surface fully surrounded by the surrounding sidewall and opposite to the top surface of the second coupling member, wherein the top surface of the first coupling member engages with the bottom surface of the keycap, and an entire surface of the top surface of first coupling member is flat and lies on a same plane, wherein said elastic member extends into the receiving space of said abutting portion and said contact surface is abutted against said elastic member for allowing said keycap to be pressed with said reinforcing member against said elastic member to trigger a circuit switch, and wherein the receiving space has an area corresponding to the elastic member, and said surrounding sidewall of the receiving space is distanced from all of outermost edges of the second coupling member.

16. The enhanced push-button as claimed in claim 15, wherein a thickness between said contact surface and the top surface of said abutting portion of said second coupling member is less than a thickness of the first coupling member between the top surface and bottom surface thereof.

17. The enhanced push-button as claimed in claim 15, wherein the height of said contact surface of said abutting portion of said second coupling member is selectively flush with, or higher or lower than the top surface of first coupling member.

* * * * *